US009518228B2

(12) United States Patent
Chung

(10) Patent No.: US 9,518,228 B2
(45) Date of Patent: Dec. 13, 2016

(54) APPARATUS FOR COLLECTING INTERMEDIATE OIL FROM OIL SHALE AND COLLECTING METHOD USING THE SAME

(71) Applicant: CRI CO., LTD., Deajeon (KR)

(72) Inventor: Soo Hyun Chung, Daejeon (KR)

(73) Assignee: CRI CO., LTD., Daejeon (KR)

( * ) Notice: Subject to any disclaimer, the term of this patent is extended or adjusted under 35 U.S.C. 154(b) by 0 days.

(21) Appl. No.: 14/773,889

(22) PCT Filed: Feb. 17, 2014

(86) PCT No.: PCT/KR2014/001274

§ 371 (c)(1),
(2) Date: Sep. 9, 2015

(87) PCT Pub. No.: WO2014/142446

PCT Pub. Date: Sep. 18, 2014

(65) Prior Publication Data

US 2016/0017236 A1 Jan. 21, 2016

(30) Foreign Application Priority Data

Mar. 11, 2013 (KR) ..... 10-2013-0025437

(51) Int. Cl.
*C10G 1/04* (2006.01)

(52) U.S. Cl.
CPC ..... *C10G 1/045* (2013.01)

(58) Field of Classification Search
CPC ..... C10G 1/045; C10B 3/02; C10B 5/10
See application file for complete search history.

(56) References Cited

U.S. PATENT DOCUMENTS 4,502,942 A 3/1985 Lee et al.
4,560,547 A 12/1985 Schora et al.
(Continued)

FOREIGN PATENT DOCUMENTS

EP 1 361 262 A1 11/2003
KR 10-1986-0009104 A 12/1986
(Continued)

OTHER PUBLICATIONS

Paul et al, Handbook of Industrial Mixing, 2003, John Wiley and Sons, 352-353.*
(Continued)

*Primary Examiner* — Randy Boyer
*Assistant Examiner* — Juan Valencia
(74) *Attorney, Agent, or Firm* — STIP Law Group, LLC

(57) ABSTRACT

An apparatus for collecting kerogen contained in oil shale in a form of intermediate oil using an alternate operating scheme, and collecting method using the same comprising: a) installing a heating coil and a heating jacket through which a heat carrier passes and a support for supporting the heating coil, in a body of an extraction device, b) heating and stiffing sludge containing kerogen decomposition intermediate in a middle storage tank again, c) collecting an extraction agent or low boiling point oil discharged and reusing the collected extraction agent or oil in the middle storage tank, d) separating the sludge discharged from the middle storage tank into an intermediate oil/extraction agent mixture oil and residual sludge through a sludge separation device, and e) separating the separated mixture oil into the extraction agent and the intermediate oil by a separation distillation column and preheating and reusing the separated extraction agent.

17 Claims, 4 Drawing Sheets

(56) References Cited

U.S. PATENT DOCUMENTS

| | | | |
|---|---|---|---|
| 4,600,476 | A | 7/1986 | Edwards |
| 7,500,517 | B2 | 3/2009 | Looney et al. |
| 2011/0094940 | A1 | 4/2011 | Weisselberg |

FOREIGN PATENT DOCUMENTS

| | | | |
|---|---|---|---|
| KR | 10-2011-0138375 | A | 12/2011 |
| WO | 2005/028255 | A1 | 3/2005 |

OTHER PUBLICATIONS

International Search Report for PCT/KR2014/001274 dated Jun. 20, 2014.

* cited by examiner

APPARATUS FOR COLLECTING INTERMEDIATE OIL FROM OIL SHALE AND COLLECTING METHOD USING THE SAME

RELATED APPLICATIONS

This application is the U.S. National Phase under 35 U.S.C. §371 of International Application No. PCT/KR2014/001274, filed on Feb. 17, 2014, which in turn claims the benefit of Korean Application No. 10-2013-0025437, filed on Mar. 11, 2013, the disclosures of which are incorporated by reference into the present application.

TECHNICAL FIELD

The present invention relates to an apparatus for effectively recovering kerogen contained in oil shale in the form of heavy oil by alternate operation, and a recovery method using the same. More particularly, the present invention relates to an apparatus and method for recovery of heavy oil, which a) maximizes heating and mixing effects by providing a heating coil and a heating jacket, through which a heat medium passes, and a support which supports the heating coil in an extractor body; b) heats and stirs sludge containing heavy oil with decomposed kerogen, extracted by a kerogen extractor, by means of an intermediate storage tank; b) recovers an extract or low-boiling point oil discharged while the pressure of the extractor is returned to atmospheric pressure by means of an extract recovery tank such that the recovered extract or low-boiling point oil is reused by the intermediate storage tank; d) separates the sludge discharged from the intermediate storage tank into mixed oil of heavy oil and extract and residual sludge by means of a sludge separator; and e) separates the mixed oil into the extract and the heavy oil by means of a heavy oil distillation column and heats the separated extract to be reused. Here, with the alternate operation, it is possible to continuously treat oil shale and further use an extraction additive in addition to the extract.

According to the present invention, it is possible to significantly increase the recovery rate of heavy oil and increase the extraction yield of kerogen components at relatively low temperatures, thus reducing the cost of energy per unit price for crude oil production and significantly reducing air pollutants since there is no need to burn residues, compared with existent retorting methods.

BACKGROUND ART

In general, methods of obtaining shale oil from oil shale include a direct heating method of bringing oil shale into direct contact with a heating medium and an indirect heating method of feeding oil shale into a reactor and heating the oil shale. Shale oil obtained by the heating process has properties similar to crude oil and thus has attracted attention as a next-generation oil resource.

Specifically, methods of recovering crude oil components from oil shale include a method of mining and retorting oil shale and a method of heating oil shale buried underground without mining. The retorting method includes a method of feeding oil shale into a reactor and heating the oil shale from the outside, a method of bringing oil shale into contact with combustion gas to be pyrolyzed, a method of brining a heated solid medium into contact with heated raw oil shale in a solid-solid phase, etc.

Unlike the above-described methods, the method of heating oil shale buried underground includes a method of recovering shale oil by electric heating or using heated combustion gas. According to this method, it is possible to obtain shale oil similar to that obtained by the existing retorting method or light oil of low boiling point.

Since both of these two methods heat nonconductive oil shale, a significant amount of kerogen components are converted into non-condensable gas, not shale oil, and thus, in most cases, the yield of crude oil components is very low, at less than 40%, on the basis of volatile matters contained in oil shale rocks.

Moreover, a significant amount of kerogen is decomposed when the oil shale is heated and remains in the form of carbon in the oil shale or in the form of high-boiling point components. As such, when the carbon components or high-boiling point components remaining in the oil shale are buried as they are, they cause soil or water pollution and thus are subjected to combustion.

At this time, the combustion energy generated by the combustion of waste oil shale is generally recovered and used as an energy source for pyrolysis of oil shale. During the combustion process, a large amount of carbon dioxide or carcinogens such as dioxin are emitted, which are the main cause of global warming and environmental pollution, and thus an alternative technique for emission suppression is required.

That is, the conventional processes of recovering crude oil components by directly or indirectly heating oil shale have a high cost of energy per unit price for crude oil production and cause environmental problems due to the emission of pollutants and carbon dioxide generated during the combustion of organic components in the residues, and thus the development of a crude oil recovery apparatus and method, which is environmentally friendly and can increase the crude oil production, has been required.

INFORMATION ON PRIOR ARTS

1. U.S. Pat. No. 4,576,708
2. U.S. Pat. No. 4,963,250
3. U.S. Pat. No. 5,000,389
4. U.S. Pat. No. 7,500,517

DISCLOSURE

Technical Problem

The present invention has been made in an effort to solve the above-described problems associated with prior art, and an object of the present invention is to provide an apparatus and method for recovery of heavy oil, which can extract kerogen components in the form of heavy oil, not in the form of polymer in a temperature range of 200~400° C., which is lower than the typical oil shale pyrolysis temperature of 500° C., and convert most volatile matters in oil shale rocks into crude oil components, which makes it possible to significantly increase the recovery rate and, at the same time, reduce the cost of energy per unit price for crude oil production.

Moreover, the present invention provides an apparatus and method for recovery of heavy oil, which can recover most kerogen components under a pressurized state in the form of heavy oil, which eliminates the combustion of waste oil shale produced as a residue, thus solving the problem of emission of dioxin or carbon dioxide in quantities. Furthermore, the present invention provides an apparatus and method for recovery of heavy oil, which can reduce the amount of energy used per unit price for crude oil production, which is very economical, and further reduce the amount of carbon dioxide due to excessive use of energy.

To achieve the above objects, an aspect of the present invention provides an apparatus for recovery of kerogen components in the form of heavy oil from oil shale, the apparatus comprising a kerogen extractor (100), which comprises: an extractor body (110), in which a heating coil (111) and a first heating jacket (112), through which a heat medium passes, are installed on inner and outer walls of the body, and which extracts kerogen components in the form of heavy oil from oil shale by using an extract under a pressurized state; an oil shale feeder (120) which feeds dried oil shale into the extractor body (110) and includes a pressure damper (121) for controlling the pressure in the extractor body (110); and a sludge discharger (130) which discharges sludge, in which heavy oil with decomposed kerogen and solid oil shale are mixed, to an intermediate storage tank (200) and includes a pressure damper (131) for controlling the pressure in the extractor body (100).

Preferably, a stirrer (113) through which the heat medium passes may be provided in the extractor body (110), and a support (114) for supporting the heating coil (111) may be provided in the extractor body (110), the support (114) serving as a baffle for increasing mixing and heating effects.

Moreover, the recovery apparatus of the present invention may further comprise an intermediate storage tank (200), into which the sludge discharged from the sludge discharger (130) is fed by means of a transfer pump, and which includes a stirrer (210) for stirring the fed sludge, and a heating jacket (220) through which the heat medium passes may preferably be provided on an outer wall of the intermediate storage tank (200) to recover heavy oil.

Furthermore, the recovery apparatus of the present invention may further comprise an extract recovery tank (300) which recovers the extract or low-boiling point oil discharged while the pressure in the extractor body (110) is controlled from the pressurized state to atmospheric pressure and re-feeds the recovered extract or low-boiling point oil to the intermediate storage tank (200).

Meanwhile, a plurality of unit extractors, each comprising the kerogen extractor (100) and the intermediate storage tank (200), may be provided to be alternately operated, thus allowing continuous treatment of oil shale.

In addition, the recovery apparatus of the present invention may further comprise a sludge separator (400), into which the sludge discharged from the intermediate storage tank (200) is transferred by means of a transfer pump, and which separates the fed sludge into a liquid mixture of heavy oil with decomposed kerogen and an extract, and a residual solid sludge.

Additionally, the recovery apparatus of the present invention may further comprise a mixed oil storage tank (500) which stores the heavy oil with decomposed kerogen and the extract, separated by the sludge separator (400), and transfers the stored mixed oil to a heavy oil distillation column (700) by means of a transfer pump.

Here, the recovery apparatus of the present invention may further comprise an extraction additive tank (600) which stores an extraction additive for increasing the extraction effect of kerogen and feeds the stored extraction additive into the heavy oil distillation column (700) by means of a transfer pump.

Moreover, the recovery apparatus of the present invention may further comprise a heavy oil distillation column (500) which separates the mixed oil fed from the mixed oil storage tank (500) into heavy oil, low-boiling point oil, and extract, recovers the separated heavy oil and low-boiling point oil, and feeds the extract into an extract storage tank (800).

Furthermore, the recovery apparatus of the present invention may further comprise an extract preheater (900) which preheats the extract fed from the extract storage tank (800) in a heat exchanging manner and re-feeds the preheated extract into the extractor body (110).

In addition, the recovery apparatus of the present invention may further comprise a heat medium boiler which heats the heat medium and circulates the heated heat medium through the heating coil (111), the heating jacket (112), the stirrer (113), and the heating jacket (220).

Another aspect of the present invention provides a method for recovery of heavy oil using the above-described apparatus, the method comprising the steps of: a) feeding a preheated extract into an extractor body (110), heating the extract by means of a heating coil (111) and a first heating jacket (112), through which a heat medium passes, adding oil shale to the heated extract by opening a pressure damper (121) at the top, closing the pressure damper (121), and stirring the resulting mixture under pressurized state to extract kerogen components while maintaining the temperature in the extractor body (110) at 200 to 400° C.; b) controlling a pressure control valve connected to an extract recovery tank (300) when the extraction is completed, returning the pressure in the extractor body (110) to atmospheric pressure, recovering the extract or low-boiling point oil discharged during the returning process, and re-feeding the recovered extract or low-boiling point oil into an intermediate storage tank (200); c) transferring sludge, in which heavy oil with decomposed kerogen and solid oil shale are mixed, to the intermediate storage tank (200) by opening a pressure damper (131) and operating a transfer pump when the pressure in the extractor body (110) is returned to the atmospheric pressure, and stirring the transferred sludge and the extract recovered by the extract recovery tank (300) while heating them by means of a heating jacket (220) to further recover the heavy oil in the intermediate storage tank (200); d) transferring the sludge discharged from the intermediate storage tank (200) to a sludge separator (400) by means of a transfer pump and separating the sludge into a liquid mixture of heavy oil with decomposed kerogen and an extract, and a residual solid sludge; e) temporarily storing the heavy oil and the mixed oil containing the extract, separated by the sludge separator (400), in a mixed oil storage tank (500) and then transferring them to a heavy oil distillation column (700) by means of a transfer pump; f) separating, at the heavy oil distillation column (700), the heavy oil, the low-boiling point oil, and the extract, recovering the separated heavy oil and low-boiling point oil, and storing the extract in an extract storage tank (800); and g) transferring the stored extract to an extract preheater (900) to be heated and feeding the heated extract into the extractor body (110) to be reused.

Here, the heat medium circulating through the heating coil (111), the heating jacket (112), and the heating jacket (220) may be heated and circulated by a heat medium boiler (910) to recover the heavy oil.

Moreover, the recovery method of the present invention may further comprise the step of, before the step of f) separating, at the heavy oil distillation column (700), the heavy oil, the low-boiling point oil, and the extract, feeding an extraction additive stored in an extraction additive tank (600) to the heavy oil distillation column by means of a transfer pump.

Furthermore, a plurality of unit extractors, each comprising the kerogen extractor (100) and the intermediate storage tank (200), may be provided to be alternately operated, such as alternative operation between a) step comprising the kerogen extractor (100) and b) step comprising the intermediate storage tank (200), thus allowing continuous treatment of oil shale.

Advantageous Effect

When heavy oil is recovered from oil shale using the recovery apparatus of the present invention, it is possible to extract kerogen components in the form of heavy oil in a temperature range lower than the typical oil shale pyrolysis temperature and convert most volatile matters in oil shale rocks into crude oil components, which makes it possible to significantly increase the recovery rate and, at the same time, reduce the cost of energy per unit price for crude oil production.

Moreover, it is possible to recover most kerogen components under a pressurized state in the form of heavy oil, which eliminates the combustion of waste oil shale produced as a residue, thus solving the problem of emission of dioxin or carbon dioxide in quantities. Furthermore, it is possible to reduce the amount of energy used per unit price for crude oil production, which is very economical, and further reduce the amount of carbon dioxide due to excessive use of energy, which is environmentally friendly.

MODE OF INVENTION

Hereinafter, an apparatus for recovery of heavy oil from kerogen in oil shale and a recovery method using the same according to the present invention will be described with reference to the accompanying drawings.

Figure 1:
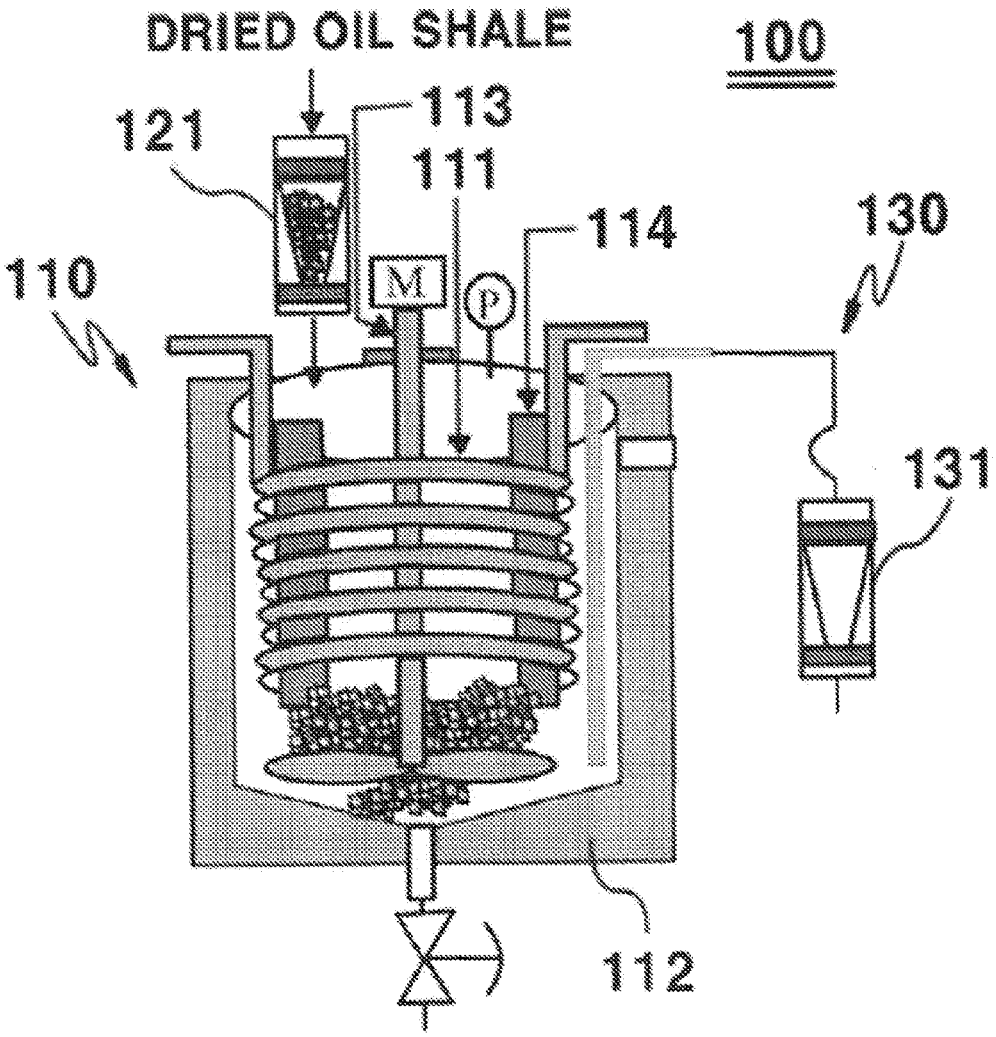
FIG. 1 is a cross-sectional view showing the configuration of a kerogen extractor according to the present invention.

First, as shown in FIG. 1, an apparatus for recovery of kerogen components in the form of heavy oil from oil shale according to the present invention includes a kerogen extractor (100) comprising an extractor body (110) which extracts kerogen components in the form of heavy oil from oil shale, in which a heating coil (111) and a heating jacket (112), through which a heat medium passes, are installed on the inner and outer walls of the body, an oil shale feeder which feeds dried oil shale into the extractor body (110) and includes a pressure damper (121) for controlling the pressure in the extractor body (110), and a sludge discharger (130) which discharges sludge, in which heavy oil with decomposed kerogen and solid oil shale are mixed, to an intermediate storage tank (200) and includes a second pressure damper (131) for controlling the pressure in the extractor body (110).

Here, it is preferable that a stirrer (113), through which the heat medium passes, is provided in the extractor body (110) and a support (114) for supporting the heating coil (111) is provided in the extractor body (110) such that the support (114) serves as a baffle for increasing mixing and heating effects.

Figure 2:
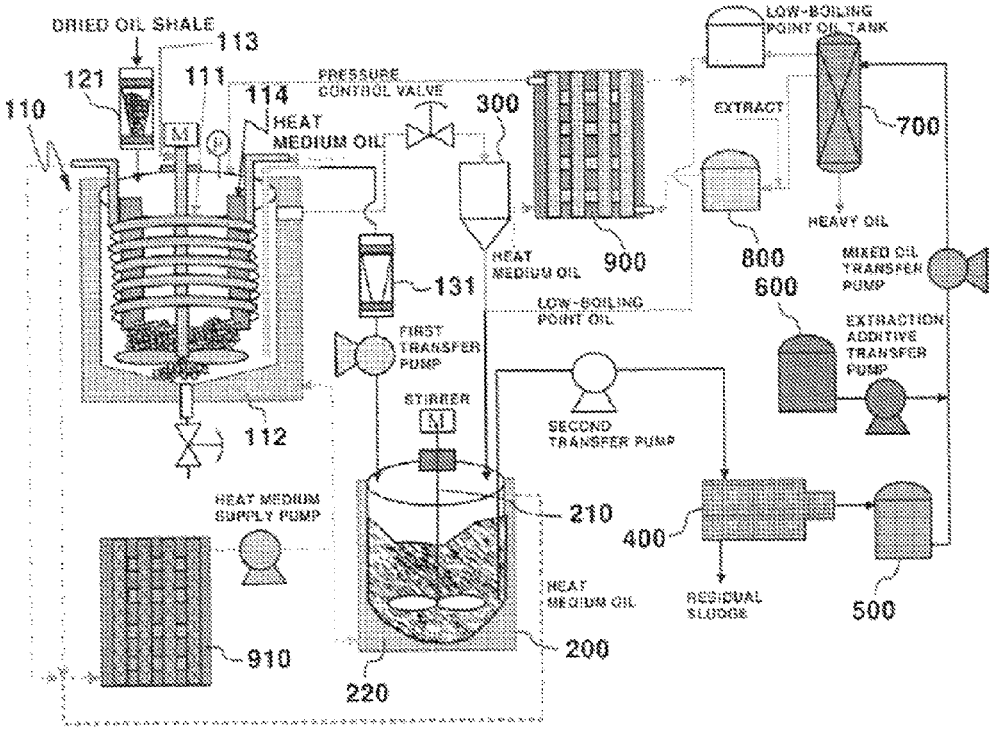
FIG. 2 is a process diagram showing a method for recovering heavy oil from kerogen in oil shale according to the present invention.

An extraction process using the extractor (100) will be described in detail with reference to FIG. 2 below. First, a preheated extract is fed into the extractor body (110) and heated by the heating coil (111), the stirrer (113) and the first heating jacket (112), through which the heat medium passes. Preheated oil shale is added to the heated extract by opening the pressure damper (121) at the top and then the pressure damper (121) is closed again. The resulting mixture is stirred under pressurized state such that kerogen components are extracted in the form of heavy oil while maintaining the temperature in the extractor body (110) in a temperature range of 200 to 400° C.

Unlike the conventional pyrolysis retorts, the extractor (100) of the present invention employs a heat medium heating method to heat the outer wall of the extractor using a jacket through which a heat medium passes and heat the inside of the extractor using a coil through which the heat medium passes. It is preferable that the heat medium circulating through the heating coil (111), the heating jacket (112), and the stirrer (113) is heated and circulated by a heat medium boiler (910) separately installed to recover the heavy oil.

Moreover, the support that supports the coil is welded to the coil such that the support serves to support the coil and further serves as a fin which forms a vortex due to the stirring, thus maximizing the heating effect of a heating tube in the form of a coil.

With the above-described heat medium heating method, it is possible to extract kerogen contained in the rock in the form of heavy oil, not in the form of polymer, by pressure extraction in a temperature range of 200~400° C., which is lower than the typical pyrolysis temperature of 500° C.

Furthermore, the method for recovery of kerogen in the form of heavy oil under a pressurized state does not have to burn waste oil shale residue produced as a residue and thus can solve the problem of emission of dioxin or carbon dioxide in quantities.

When the extraction is completed in the extractor (100), the pressure in the extractor body (110) is returned to atmospheric pressure by controlling a pressure control valve connected to an extract recovery tank (300), and the extract or low-boiling point oil discharged during the returning process is recovered in the extract recovery tank (300) and then re-fed into the intermediate storage tank (200).

With the use of the extract or low-boiling point oil recovered in the extract recovery tank (300) and re-fed into the intermediate storage tank (200), it is possible to increase the recovery rate and minimize the residual organic content of waste oil shale residue.

When the pressure in the extractor body (110) is returned to the atmospheric pressure, the pressure damper (131) is opened and a transfer pump is operated to transfer sludge, in which heavy oil with decomposed kerogen and solid oil shale are mixed, to the intermediate storage tank (200).

Here, the transferred sludge and the extract or low-boiling point oil recovered in the extract recovery tank (300) are heated by a heating jacket (220) and sufficiently mixed and stirred, and it is preferable that a heat medium circulating through the heating jacket (220) is heated and circulated by the heat medium boiler (910) separately installed to recover the heavy oil.

Through the additional heating and stirring processes using the intermediate storage tank (200), it is possible to convert most volatile matters in oil shale rocks into crude oil components, which makes it possible to increase the recovery rate and, at the same time, reduce the cost of energy per unit price for crude oil production.

Figure 3:
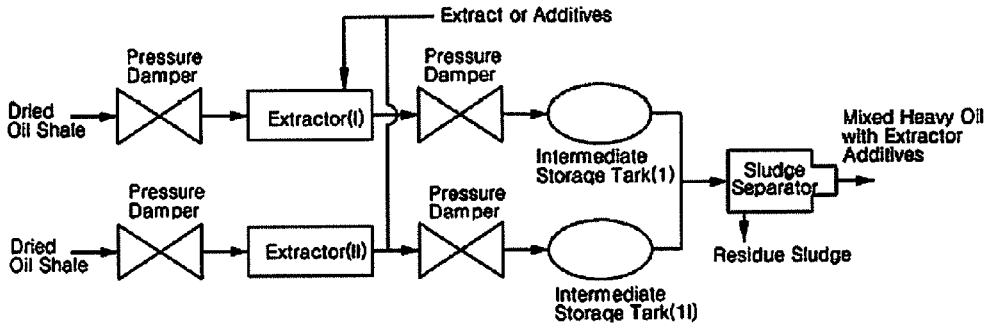
FIG. 3 is a process flowchart showing an alternate operational method for recovering heavy oil according to the present invention.

Meanwhile, the sludge discharged from the intermediate storage tank (200) is transferred to a sludge separator (400) by means of a transfer pump. Here, as shown in FIG. 3, more than two unit extractors, each comprising the kerogen extractor (100) and the intermediate storage tank (200) according to the present invention, are provided to be alternately operated such that the oil shale can be continuously treated. With the continuous treatment through the alternate operation, it is possible to further increase the recovery rate of heavy oil.

The sludge discharged from the intermediate storage tank (200) is transferred to the sludge separator (400) by means of a transfer pump, and the sludge separator (400) separates the sludge into a liquid mixture of heavy oil with decomposed kerogen and an extract, and a residual solid sludge.

The heavy oil and the mixed oil containing the extract, separated by the sludge separator (400), are temporarily stored in a mixed oil storage tank (500) and then transferred to a heavy oil distillation column (700).

The heavy oil distillation column (700) separates the mixed oil into heavy oil, low-boiling point oil, and extract. Then, the separated heavy oil and low-boiling point oil are recovered, and the extract is temporarily stored in an extract storage tank (800). Here, the stored extract is transferred to an extract preheater (900) to be heated and then fed into the extractor body (110) to be reused.

Meanwhile, when an extraction additive is used to effectively extract kerogen, the extraction additive stored in an extraction additive tank (600) may be fed into the heavy oil distillation column (700) by means of a transfer pump, before the heavy oil, the low-boiling point oil, and the extract are separated by the heavy oil distillation column (700).

Next, the present invention will be described in more detail through the following examples. However, the following examples are provided only for illustrations and thus the scope of the present invention is not limited to these examples.

Examples

Figure 4:
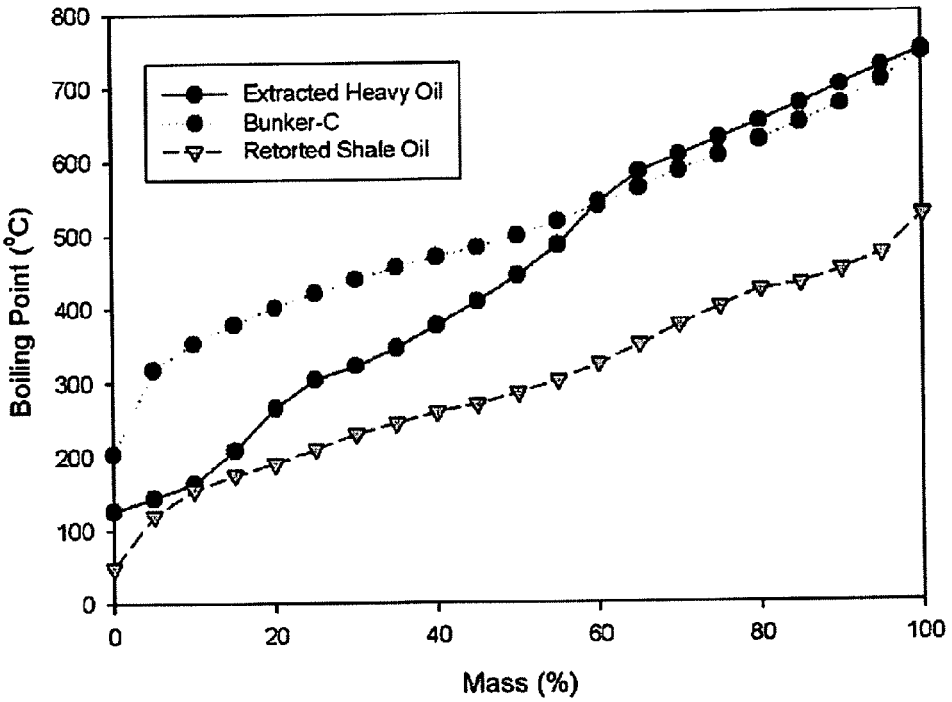
FIG. 4 is a graph comparing the boiling point distribution of heavy oil extracted from oil shale according to an exemplary embodiment of the present invention, commercially available bunker-C oil, and shale oil recovered from oil shale by the existing pyrolysis method.

FIG. 4 is a graph comparing the boiling point distributions of heavy oil extracted from oil shale according to an exemplary embodiment of the present invention, commercially available bunker-C oil, and shale oil recovered by oil shale pyrolysis. The boiling point distributions of a mixed liquid of the extract and the extraction additive used in the Examples of the present invention were in the range of 200 to 400° C.

It could be found that the boiling point distribution of the heavy oil recovered according to the present invention was much higher than that of shale oil obtained by the Fischer Assay method, an existing pyrolysis method. Both of two oil samples were obtained from the same oil shale. Meanwhile, it can be seen that the boiling point distribution of the extracted heavy oil is lower than that of bunker-C oil at a boiling point distribution below 60%.

The reason for these results is that the extracted heavy oil obtained from kerogen in oil shale is less susceptible to gasification than shale oils obtained by existing methods, and it can be seen that the extracted heavy oil obtained from kerogen in oil shale has a wider boiling point distribution over the entire boiling point distribution. Consequently, the yield of the extracted heavy oil according to the present invention can be maintained much higher than that of shale oil obtained by the typical pyrolysis method.

While the invention has been shown and described with reference to certain preferred embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

INDUSTRIAL APPLICABILITY

The present invention has industrial applicability since it has been made in an effort to solve the above-described problems associated with prior art, and an object of the present invention is to provide an apparatus and method for recovery of heavy oil, which can extract kerogen components in the form of heavy oil, not in the form of polymer in a temperature range of 200~400° C., which is lower than the typical oil shale pyrolysis temperature of 500° C., and convert most volatile matters in oil shale rocks into crude oil components, which makes it possible to significantly increase the recovery rate and, at the same time, reduce the cost of energy per unit price for crude oil production; and can recover most kerogen components under a pressurized state in the form of heavy oil, which eliminates the combustion of waste oil shale produced as a residue, thus solving the problem of emission of dioxin or carbon dioxide in quantities; can provide an apparatus and method for recovery of heavy oil, which can reduce the amount of energy used per unit price for crude oil production, which is very economical, and further reduce the amount of carbon dioxide due to excessive use of energy.

What is claimed is:

1. An apparatus for recovery of kerogen components in a form of heavy oil from oil shale, the apparatus comprising a kerogen extractor, which comprises:

an extractor body, in which a heating coil and a heating jacket, through which a heat medium passes, are installed on inner and outer walls of the body, and which extracts kerogen components in the form of heavy oil from oil shale by using an extract under a pressurized state;

an oil shale feeder which feeds dried oil shale into the extractor body and includes a pressure damper for controlling the pressure in the extractor body; and a sludge discharger which discharges sludge, in which heavy oil with decomposed kerogen and solid oil shale are mixed, to an intermediate storage tank and includes a pressure damper for controlling the pressure in the extractor body.

2. The apparatus of claim 1, wherein a support for supporting the heating coil is provided in the extractor body, the support serving as a baffle for increasing mixing and heating effects.

3. The apparatus of claim 1, further comprising an intermediate storage tank, into which the sludge discharged from the sludge discharger is fed by means of a transfer pump, and which includes a stirrer for stirring the fed sludge.

4. The apparatus of claim 3, further comprising an extract recovery tank which recovers the extract or low-boiling point oil discharged while the pressure in the extractor body is controlled from the pressurized state to atmospheric pressure and re-feeds the recovered extract or low-boiling point oil to the intermediate storage tank.

5. The apparatus of claim 3, wherein a plurality of unit extractors, each comprising the kerogen extractor and the intermediate storage tank, are provided to be alternately operated, thus allowing continuous treatment of oil shale.

6. The apparatus of claim 3, further comprising a sludge separator, into which the sludge discharged from the intermediate storage tank is transferred by means of a transfer pump, and which separates the fed sludge into a liquid mixture of heavy oil with decomposed kerogen, extract, and residual solid sludge.

7. The apparatus of claim 6, further comprising a mixed oil storage tank which stores the heavy oil with decomposed kerogen and the extract, separated by the sludge separator, and transfers the stored mixed oil to a heavy oil distillation column by means of a transfer pump.

8. The apparatus of claim 7, further comprising an extraction additive tank which stores an extraction additive for increasing the extraction effect of kerogen and feeds the stored extraction additive into the heavy oil distillation column by means of a transfer pump.

9. The apparatus of claim 7, further comprising a heavy oil distillation column which separates the mixed oil fed from the mixed oil storage tank into heavy oil, low-boiling point oil, and extract, recovers the separated heavy oil and low-boiling point oil, and feeds the extract into an extract storage tank.

10. The apparatus of claim 8, further comprising an extract preheater which preheats the extract fed from the extract storage tank in a heat exchanging manner and re-feeds the preheated extract into the extractor body.

11. The apparatus of claim 1, further comprising a heat medium boiler which heats the heat medium and circulates the heated heat medium through the heating coil, the first heating jacket, the stirrer and the second heating jacket.

12. A method for recovery of heavy oil, utilizing the apparatus of claim 1, comprising the steps of:

a) feeding a preheated extract into the extractor body, heating the extract by means of the heating coil and the heating jacket, through which the heat medium passes, adding oil shale to the heated extract by opening the pressure damper at the top, closing the pressure damper, and stirring the resulting mixture under pressurized state to extract kerogen components while maintaining the temperature in the extractor body at 200 to 400° C.;

b) controlling a pressure control valve connected to an extract recovery tank when the extraction is completed, returning the pressure in the extractor body to atmospheric pressure, recovering the extract or low-boiling point oil discharged during the returning process, and re-feeding the recovered extract or low-boiling point oil into an intermediate storage tank;

c) transferring sludge, in which heavy oil with decomposed kerogen and solid oil shale are mixed, to the intermediate storage tank by opening the pressure damper and operating a transfer pump when the pressure in the extractor body is returned to the atmospheric pressure, and stirring the transferred sludge and the extract recovered by the extract recovery tank while heating them by means of a heating jacket to further recover the heavy oil in the intermediate storage tank;

d) transferring the sludge discharged from the intermediate storage tank to a sludge separator by means of the transfer pump and separating the sludge into a liquid mixture of heavy oil with decomposed kerogen and an extract, and a residual solid sludge;

e) temporarily storing the heavy oil and the mixed oil containing the extract, separated by the sludge separator, in a mixed oil storage tank and then transferring them to a heavy oil distillation column by means of a transfer pump;

f) separating, at the heavy oil distillation column, the heavy oil, the low-boiling point oil, and the extract, recovering the separated heavy oil and low-boiling point oil, and storing the extract in an extract storage tank; and g) transferring the stored extract to an extract preheater to be heated and feeding the heated extract into the extractor body to be reused.

13. The method of claim 12, wherein the heat medium circulating through the heating coil, the heating jacket, and the heating jacket is heated and circulated by a heat medium boiler to recover the heavy oil.

14. The method of claim 12, further comprising the step of, before the step of f) separating, at the heavy oil distillation column, the heavy oil, the low-boiling point oil, and the extract, feeding an extraction additive stored in an extraction additive tank to the heavy oil distillation column by means of a transfer pump.

15. The method of claim 12, wherein a plurality of unit extractors, each comprising the kerogen extractor and the intermediate storage tank, are provided to be alternately operated thus allowing continuous treatment of oil shale.

16. The apparatus of claim 1, wherein a stirrer through which the heat medium passes is provided in the extractor body.

17. The apparatus of claim 3, wherein a second heating jacket through which the heat medium passes is provided on an outer wall of the intermediate storage tank to recover heavy oil.

* * * * *